US009045815B2

(12) United States Patent
Lee et al.

(10) Patent No.: US 9,045,815 B2
(45) Date of Patent: Jun. 2, 2015

(54) ALUMINUM ALLOY FOR DIE-CASTING

(75) Inventors: Jung Taek Lee, Suwon (KR); Myeong Hyoen Nam, Gwangmyeong (KR); Kab Yong Park, Hwaseong (KR); Jong Hoon Jeong, Siheung (KR)

(73) Assignee: GK CORPORATION, LTD., Ansan (KR)

( * ) Notice: Subject to any disclaimer, the term of this patent is extended or adjusted under 35 U.S.C. 154(b) by 150 days.

(21) Appl. No.: 13/818,118

(22) PCT Filed: Dec. 20, 2011

(86) PCT No.: PCT/KR2011/009846

§ 371 (c)(1),
(2), (4) Date: Feb. 21, 2013

(87) PCT Pub. No.: WO2012/102485

PCT Pub. Date: Aug. 2, 2012

(65) Prior Publication Data

US 2013/0156635 A1 Jun. 20, 2013

(30) Foreign Application Priority Data

Jan. 27, 2011 (KR) ..... 10-2011-0008077

(51) Int. Cl.

| | |
|---|---|
| ***C22C 21/00*** | (2006.01) |
| ***C22C 21/10*** | (2006.01) |
| ***C22C 21/16*** | (2006.01) |
| ***C22C 21/18*** | (2006.01) |

(Continued)

(52) U.S. Cl.

CPC ..... *C22C 21/00* (2013.01); *C22C 1/026* (2013.01); *C22C 1/03* (2013.01)

(58) Field of Classification Search

CPC ..... C22C 21/00; C22C 21/10; C22C 21/16; C22C 21/18; C22C 1/026; C22C 1/03

USPC ..... 420/531, 532

See application file for complete search history.

(56) References Cited

U.S. PATENT DOCUMENTS 6,355,090 B1 3/2002 Ohyama et al.

FOREIGN PATENT DOCUMENTS

| | | |
|---|---|---|
| CN | 1263566 | 8/2000 |
| JP | S52-133012 | 11/1977 |
| JP | S54-065110 | 5/1979 |

(Continued)

OTHER PUBLICATIONS

English Abstract of Kusui et al. (JP 63-157831) (Jun. 30, 1988).*

(Continued)

*Primary Examiner* — Jessee Roe

(74) *Attorney, Agent, or Firm* — Fildes & Outland, P.C.

(57) ABSTRACT

The present invention relates to an aluminum alloy for die-casting. More particularly, the present invention relates to an aluminum alloy being usable for die-casting and including 1.0% to 5.0% by weight of Mn, 0.5% to 1.5% by weight of Zn, 1.0% to 2.0% by weight of Zr, 0.5% to 1.5% by weight of Cu and 85% to 97% by weight of aluminum. Surface smut due from silicon smutting is not caused after a molding process so that a product can have a clear color, Furthermore, the aluminum alloy can increase an adhesion strength of a coating layer thereby increasing a durability of a die-casting product. Furthermore, because the aluminum alloy does not include a heavy metal harmful to human being, the aluminum alloy may be non-toxic and environment-friendly.

6 Claims, 1 Drawing Sheet

(51) Int. Cl.
*C22C 1/02* (2006.01)
*C22C 1/03* (2006.01)

(56) References Cited

FOREIGN PATENT DOCUMENTS

| | | |
|---|---|---|
| JP | S62-142739 | 6/1987 |
| JP | S63-157831 | 6/1988 |
| JP | 05-113729 | 5/1993 |
| JP | 11-513439 | 11/1999 |
| JP | 2002-146463 | 5/2002 |
| JP | 2002-206133 | 7/2002 |
| WO | 97/13882 | 4/1997 |

OTHER PUBLICATIONS

English language abstract for S52-133012.
English language abstract for S54-065110.
English language abstract for S62-142739.
English language abstract for S63-157831.
English abstract for JP 2002-206133.
English abstract for JP 2002-146463.
English abstract for JP 05-113729.
International search report in PCT/KR2011/009846.
Office Action from the State Intellectual Property Office of China in corresponding Chinese Patent Application No. 201180061458.2, dated Sep. 30, 2014.
English abstract for CN 1263566, Aug. 16, 2000.

* cited by examiner

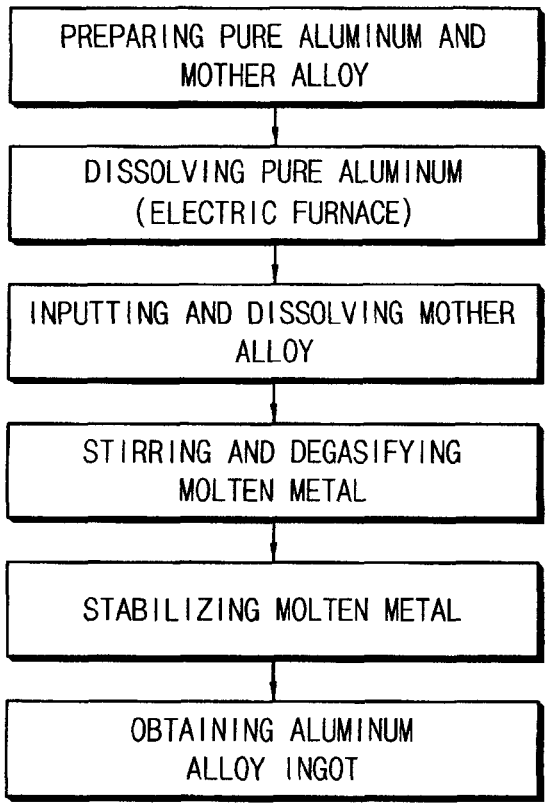
PREPARING PURE ALUMINUM AND MOTHER ALLOY
DISSOLVING PURE ALUMINUM (ELECTRIC FURNACE)
INPUTTING AND DISSOLVING MOTHER ALLOY
STIRRING AND DEGASIFYING MOLTEN METAL
STABILIZING MOLTEN METAL
OBTAINING ALUMINUM ALLOY INGOT

ALUMINUM ALLOY FOR DIE-CASTING

TECHNICAL FIELD

The present invention relates to an aluminum alloy for die-casting. More particularly, the present invention relates to an aluminum alloy being usable for die-casting and including 1.0% to 5.0% by weight of Mn, 0.5% to 1.5% by weight of Zn, 1.0% to 2.0% by weight of Zr, 0.5% to 1.5% by weight of Cu and 85% to 97% by weight of aluminum.

BACKGROUND ART

An aluminum alloy has a light weight and a high strength so that an aluminum alloy is used for durable goods. Especially, an aluminum alloy is recently being for parts of a motor vehicle or for a case of an electronic device such as a mobile phone.

Two methods are generally used for manufacturing an aluminum alloy product. According to one method, an aluminum board is processed through a press-forming method to form a case, and the case is covered with an anodic oxidation coat. The case covered with the anodic oxidation coat can be used for a long time without damage, and can have a surface having a clear color. However, when the aluminum board is processed through the press-forming method to form the case, it is difficult to form a rib for reinforcement of the case, a space for parts disposed in the case, and a boss for screw combination. Furthermore, because some shapes cannot be obtained through the press-forming method, a design of the case is limited.

According to another method, a case of an electronic device may be formed from an aluminum alloy through a die-casting method. When the case is formed through the die-casting method, it is relatively easy to form a rib for reinforcement of the case, a space for parts disposed in the case, and a boss for screw combination. Thus, a design of the case can be determined more freely. However, an aluminum alloy for a die-casting method includes various metallic or non-metallic additives such as silicon or the like to improve flexibility. When the die-casting method is progressed, the additives migrate to near a surface. Thus, even if the case is coated with an anodic oxidation coat and colored, smut appears on a surface so that the case cannot have a clear color. Thus, a method of forming an additional coating layer on the die-casting-formed cover may be used. However, when the cover is used for a long time, the additional coating layer may be stripped.

Thus, there is a require developing a novel aluminum alloy for a die-casting method such that the aluminum alloy has a light weight and a high durability and can form a uniform anodic oxidation coat to provide a product having a clear color as well as to easily form a product having various shapes. Furthermore, there is a require developing a novel aluminum alloy not using an additive including a heavy metal harmful to human being,

DISCLOSURE

Technical Problem

Thus, the present invention provides an aluminum alloy such that surface smut due from silicon smutting is not caused after a molding process so that a product can have a clear color. Furthermore, the aluminum alloy can increase an adhesion strength of a coating layer thereby increasing a durability of a die-casting product. Furthermore, because the aluminum alloy does not include a heavy metal harmful to human being, the aluminum alloy may be non-toxic and environment-friendly.

Technical Solution

To obviate above-mentioned problems, the present invention provides an aluminum alloy for die-casting including 1.0% to 5.0% by weight of Mn, 0.5% to 1.5% by weight of Zn, 1.0% to 2.0% by weight of Zr, 0.5% to 1.5% by weight of Cu and 85% to 97% by weight of aluminum.

Furthermore, the present invention provides an aluminum alloy for die-casting further including 0.1% to 0.6% by weight of Si.

Furthermore, the present invention provides an aluminum alloy for die-casting further including 0.5% to 1.5% by weight of Fe.

Furthermore, the present invention provides an aluminum alloy for die-casting further including equal to or less than 0.1% by weight of Ni.

Furthermore, the present invention provides an aluminum alloy for die-casting further including 0.5% to 1.0% by weight of Mg.

Furthermore, the present invention provides an aluminum alloy for die-casting further including 0.3% to 0.7% by weight of Ti.

Furthermore, the present invention provides an aluminum alloy for die-casting having a tensile strength of 180 Mpa to 250 Mpa, and an elongation of 5% to 10%.

DESCRIPTION OF DRAWINGS

FIG. 1 is a flow chart for explaining a method of preparing an aluminum alloy of the present invention.

BEST MODE

The present invention is described more fully hereinafter.

An aluminum alloy of the present invention includes 1.0% to 5.0% by weight of Mn, 0.5% to 1.5% by weight of Zn, 1.0% to 2.0% by weight of Zr, 0.5% to 1.5% by weight of Cu and 85% to 97% by weight of aluminum.

The aluminum alloy of the present invention essentially includes 1.0% to 5.0% by weight of Mn. Mn precipitates a MnAl6 phase thereby causing solid-solution strengthening and dispersion of fine precipitates to increase mechanical characteristics of the aluminum alloy. Preferably, the content of Mn in the aluminum alloy is 1.0% to 5.0% by weight based on the total weight of the aluminum alloy. When the content of Mn is less than 1% by weight based on the total weight of the aluminum alloy, mechanical characteristics of the aluminum alloy are hardly increased. When the content of Mn is more than 5% by weight based on the total weight of the aluminum alloy, surface smut appears after anodizing, Furthermore, the aluminum alloy of the present invention includes 0.5% to 1.5% by weight of Zn. Zn serves to increase mechanical characteristics. Preferably, the aluminum alloy of the present invention includes 0.5% to 1.5% by weight of Zn based on the total weight of the aluminum alloy.

Furthermore, the aluminum alloy of the present invention includes 1.0% to 2.0% by weight of Zr so that the aluminum alloy can be anodized. Furthermore, Zr serves to increase grain refinement and mechanical characteristics. Preferably, the aluminum alloy of the present invention includes 1.0% to 2.0% by weight of Zr based on the total weight of the aluminum alloy.

Furthermore, the aluminum alloy of the present invention includes 0.5% to 1.5% by weight of Cu. Cu forms solid solution in the aluminum alloy to reinforce a substrate to prevent seizure of a mold. Furthermore, when the aluminum alloy is aged at a low temperature, Cu may increase precipitation hardening thereby increasing a strength. Preferably, the aluminum alloy of the present invention includes 0.5% to 1.5% by weight of Cu based on the total weight of the aluminum alloy.

Characteristic of aluminum is well known for one skilled in the art of the present invention. Thus, further explanation will be omitted in the specification.

The aluminum alloy of the present invention may further include 0.1% to 0.6% by weight of Si. Si increases a flexibility of the aluminum alloy to improve a formability of the aluminum alloy. However, an excessive amount of Si causes smut on a surface of the aluminum alloy at an anodizing process thereby making coloring difficult and decreasing a strength of an anodic oxidation coat. Thus, the aluminum alloy of the present invention preferably includes less than or equal to 0.6% by weight of Si based on the total weight of the aluminum alloy. More than 0.6% by weight of Si may cause smut thereby making coloring the aluminum alloy difficult.

The aluminum alloy of the present invention may further include 0.5% to 1.5% by weight of Fe. Fe reduces adhesion of the aluminum alloy in a mold and prevents erosion of the mold. Preferably, the aluminum alloy of the present invention includes 0.5% to 1.5% by weight of Fe based on the total weight of the aluminum alloy. When the content of Fe is less than 0.5% by weight based on the total weight of the aluminum alloy, the aluminum alloy may be seized in the mold. When the content of Fe is more than 1.5% by weight based on the total weight of the aluminum alloy, a corrosion resistance and an anodizability of the aluminum alloy may be reduced.

The aluminum alloy of the present invention may further include equal to or less than 0.1% by weight of Ni. Ni induces grain refinement to increase elongation of the aluminum alloy. Preferably, the aluminum alloy of the present invention includes equal to or less than 0.1% of Ni based on the total weight of the aluminum alloy.

The aluminum alloy of the present invention may further include 0.5% to 1.0% by weight of Mg. Mg increases a corrosion resistance and an anodizability of the aluminum alloy. Equal to or less than 1.0% by weight of Mg may increases a strength of the aluminum alloy. However, more than 1.0% by weight of Mg may cause smut on a surface after anodizing. Thus, the aluminum alloy of the present invention preferably includes 0.5% to 1.0% by weight of Mg.

The aluminum alloy of the present invention may further include equal to or less than 0.5% by weight of Ti. Ti induces grain refinement in the aluminum alloy. Preferably, the aluminum alloy of the present invention includes equal to or less than 0.5% of Ti based on the total weight of the aluminum alloy. More than 0.5% by weight of Ti may reduce a strength of the aluminum alloy.

The aluminum alloy for die-casting of the present invention may be prepared through a general method of preparing an aluminum alloy. For example, pure aluminum is dissolved (or melted), and a mother alloy is dissolved in a molten metal of the dissolved pure aluminum. Thereafter, the molten metal is stirred and degasified to obtain an aluminum ingot. FIG. 3 is a flow chart for explaining a method of preparing an aluminum alloy of the present invention.

The aluminum alloy prepared according to the above has a tensile strength of 180 Mpa to 250 Mpa, and an elongation of 5% to 10%.

Hereafter, the present invention is described more fully with reference to specific examples.

EXAMPLE

Preparation of Aluminum Alloy for Die-Casting

In order to prepare the aluminum alloy for die-casting of the present invention, pure aluminum and mother alloy were dissolved at about 800° C., stirred, degasified and stabilized according to the following Table 1 to obtain aluminum alloy ingot.

TABLE 1

| | #0 | #1 | #2 | #3 | #4 | #5 | #6 |
|---|---|---|---|---|---|---|---|
| Mn | 1 | 1 | 2 | 3 | 4 | 5 | 2 |
| Zn | 0.5 | 0.5 | 0.7 | 1 | 1.2 | 1.5 | 1 |
| Zr | 1 | 1 | 1.5 | 2 | 1.5 | 2 | 0.7 |
| Cu | 0.5 | 0.5 | 1 | 1 | 1.5 | 1.5 | 0.5 |
| Si | — | 0.3 | 0.5 | 0.5 | 0.6 | 0.6 | — |
| Fe | — | 0.5 | 1.5 | 1 | 1.5 | 1.5 | — |
| Ni | — | 0.1 | 0.1 | — | 0.1 | — | — |
| Mg | — | 0.5 | 0.5 | 0.7 | 0.7 | 1 | 2 |
| Ti | — | 0.3 | 0.5 | 0.5 | 0.7 | 0.7 | 0.3 |
| Anodizability | ◎ | ○ | ○ | Δ | Δ | Δ | Δ |
| Formability | ◎ | ◎ | ◎ | ◎ | ◎ | ◎ | ◎ |
| Tensile strength(N/) | 205 | 210 | 214 | 212 | 213 | 216 | 200 |
| Elongation(%) | 9 | 9 | 9 | 9 | 8 | 7 | 9 |
| Yield strength(N/) | 120 | 118 | 121 | 123 | 122 | 126 | 80 |

(Δ: normal, ○: good, ◎: very good)

The present invention may, however, be embodied in many different forms and should not be construed as limited to the example embodiments set forth herein. Rather, these embodiments are provided so that this disclosure will be thorough and complete, and will fully convey the scope of the present invention to those skilled in the art.

Industrial Applicability

The present invention provides an aluminum alloy such that surface smut due from silicon smutting is not caused after a molding process so that a product can have a clear color. Furthermore, the aluminum alloy can increase an adhesion strength of a coating layer thereby increasing a durability of a die-casting product. Furthermore, because the aluminum alloy does not include a heavy metal harmful to human being, the aluminum alloy may be non-toxic and environment-friendly The invention claimed in:

1. An aluminum alloy for die-casting and anodizing comprising 1.0% to 5.0% by weight of Mn, 0.5% to 1.5% by weight of Zn, 1.0% to 2.0% by weight of Zr, 0.5% to 1.5% by weight of Cu, 0.3% to 0.7% by weight of Ti and a remainder of aluminum.

2. The aluminum alloy for die-casting and anodizing of claim 1, further comprising:

0.1% to 0.6% by weight of Si.

3. The aluminum alloy for die-casting and anodizing of claim 1, further comprising:

0.5% to 1.5% by weight of Fe.

4. The aluminum alloy for die-casting and anodizing of claim 1, further comprising:

equal to or less than 0.1% by weight of Ni.

5. The aluminum alloy for die-casting and anodizing of claim 1, further comprising:

0.5% to 1.0% by weight of Mg.

6. The aluminum alloy for die-casting and anodizing of claim 1, wherein the aluminum alloy has a tensile strength of 180 Mpa to 250 Mpa, and an elongation of 5% to 10%.

* * * * *